US007137615B2

(12) United States Patent
Ray, Jr. et al.

(10) Patent No.: US 7,137,615 B2
(45) Date of Patent: Nov. 21, 2006

(54) JACK

(75) Inventors: Hector Ray, Jr., Fullerton, CA (US); David Potts, Burbank, CA (US)

(73) Assignee: All Trade Tools LLC, Long Beach, CA (US)

( * ) Notice: Subject to any disclaimer, the term of this patent is extended or adjusted under 35 U.S.C. 154(b) by 156 days.

(21) Appl. No.: 10/814,415

(22) Filed: Mar. 31, 2004

(65) Prior Publication Data

US 2005/0218384 A1 Oct. 6, 2005

(51) Int. Cl.
*B65F 3/00* (2006.01)

(52) U.S. Cl. ..... 254/10 B; 254/89 H; 254/10 C

(58) Field of Classification Search ..... 254/8 B, 254/133 R, 10 C, 10 R, 8 C, 2 B, 89 H, 254/93 R, 93 L
See application file for complete search history.

(56) References Cited

U.S. PATENT DOCUMENTS

| | | | | |
|---|---|---|---|---|
| 2,629,583 | A | 2/1953 | Mueller | |
| 3,807,694 | A | 4/1974 | Butorac | |
| 4,018,421 | A * | 4/1977 | Tallman | 254/8 B |
| 5,221,073 | A * | 6/1993 | Shockley | 254/8 B |
| 5,269,501 | A * | 12/1993 | Liegel et al. | 269/17 |
| 5,271,603 | A * | 12/1993 | White | 254/10 C |
| 5,732,931 | A * | 3/1998 | Massel | 254/8 B |
| 5,984,270 | A * | 11/1999 | Hussaini et al. | 254/8 B |
| 6,390,451 | B1 * | 5/2002 | Baker | 254/94 |
| 6,416,039 | B1 * | 7/2002 | Pietrusynski | 254/8 B |
| D468,512 | S * | 1/2003 | Hernandez | D34/28 |
| 6,561,487 | B1 | 5/2003 | Siglock | |
| 6,769,668 | B1 * | 8/2004 | Siglock | 254/124 |
| 6,966,542 | B1 * | 11/2005 | Bettencourt | 254/131 |
| 7,004,454 | B1 * | 2/2006 | Petrone et al. | 254/10 R |
| 2002/0121632 | A1 * | 9/2002 | Siglock | 254/133 R |
| 2005/0218384 | A1 * | 10/2005 | Hernandez et al. | 254/10 B |

* cited by examiner

*Primary Examiner*—Lee D. Wilson
(74) *Attorney, Agent, or Firm*—Connors & Assoc. Inc.; John J. Connors

(57) ABSTRACT

A jack includes a base having a pair of spaced apart side members with a substantially horizontally oriented platform overlying a forward portion of the base. A pair of support arms pivotably connect the platform to the side members, and a lift arm is pivotably connected between the platform and the side members. A driver assembly mounted to a rear portion of the base in response to manual actuation moves the platform between a lowered and a plurality elevated positions while maintaining the horizontal orientation of the platform.

12 Claims, 7 Drawing Sheets

JACK

INCORPORATION BY REFERENCE

The inventors incorporate herein by reference any and all U.S. patents, U.S. patent applications, and other documents cited or referred to in this application or cited or referred to in the U.S. patents and U.S. patent applications incorporated herein by reference.

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

"Rectangular-shape" includes square-shape.

BACKGROUND OF INVENTION

U.S. Pat. No. 6,561,487 discloses a personal vehicle jack having a platform for lifting a personal vehicle such as a motorcycle, all terrain vehicle (ATV), or personal watercraft. The jack is designed to lift the entire vehicle off the floor or ground, with the vehicle balanced on a platform. This jack has stabilizing arms connected to a base to provide side-to-side stability, i.e. to prevent tipping over sideways, and lifting arms for elevating the platform in response to manual actuation of a hydraulic cylinder that operates a substantially vertically orientated ram. A user actuates the jack by stepping on a foot pedal.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: (a) a light weight, compact and sturdy jack, (b) lower costs to manufacture due to reduction in parts and use of conventional components, and (c) ease of assembly.

Without limiting the scope of this invention as expressed by the claims that follow, some, but not necessarily all, of its features are:

One, the jack of this invention in one embodiment is designed to lift a maximum load weight of about 2500 pounds and weighs less than about 85 pounds. In an elevate position, the entire load is above ground level.

Two, the jack includes a base that may be cast of metal, for example, aluminum. The base may have a pair of spaced apart, unitary, rigid, substantially planar side members each with a lower edge, at least a portion of each lower edge being adapted to rest on ground during use of the jack.

Three, each side member may have a forward segment and a rear segment. The side members may each be bent to form the forward and rear segments. The rear segments may lie inward from the forward segments. The forward segments may be separated by a first predetermined distance and may be substantially parallel and in substantial registration. Each forward segment may have a front end, a rear end, and a predetermined length. The predetermined length of each forward segment may be substantially equal and the front ends may be in substantial alignment and the rear ends may be in substantial alignment. The rear segments may be substantially parallel, separated by a second predetermined distance that is less than the first predetermined distance. The rear segments may be in substantial registration. A stiffening element, for example, an axle may extend between the forward ends of the forward segments, and the axle may carry a pair of wheels that lie outboard of the side members. The rear segments may also include one or more wheels.

Four, each side member may include an intermediate segment between its forward and rear segments. The intermediate segments may slant inward towards each other to connect the forward segment and rear segment of each side member. The side members may be mirror images of each other.

Five, the base may have a length of from about 30 to about 40 inches and the forward segments may comprise at least about 50 percent of the length of the base and the rear segments comprise no more than about 50 percent of the length of the base. The intermediate segments may comprise no more than about 25 percent of the length of the base.

Six, the jack includes a substantially horizontally oriented platform that may be cast metal, for example, aluminum. The platform may have a forward end, a rear end, opposed sides, and an upper surface adapted to support a load in an elevated position with the entire load above ground level. The platform may have a width that is substantially equal to the predetermined distance between the forward segments and a length that is substantially equal to the predetermined length of the forward segments. The platform may include a marginal frame with a hollow interior. This platform may have a substantially rectangular-shaped configuration with dimensions that are about equal to or slightly less than the dimensions of a rectangular space defined by the forward segments. For example, this substantially rectangular space situated between the forward segments may have a length from about 10 to about 25 inches and a width from about 10 to about 25 inches.

Seven, a pair of support arms may each be connected between one side member and the platform. Each support arm may have one end pivotably connected to the forward end of the platform and another end pivotably connected to an intermediary portion of a forward segment of the side member to which the support arm is connected.

Eight, a lift arm elevates the platform. The lift arm includes a forward end pivotably connected to the platform. This forward end may be connected to the rear end of the platform at a central portion thereof. The lift arm includes also a rear end pivotably mounted between the rear segments of the side members. The lift arm may be positioned lengthwise along a longitudinal axis of the jack.

Nine, a driver assembly actuates the lift arm. This driver assembly may be mounted to the base between the rear segments of the side members. The driver assembly may include a hydraulic cylinder having ram element coupled to the lift arm. The ram element in response to manual actuation moves substantially horizontal, causing the platform to move between a lowered position and a plurality of different elevated positions.

Ten, the support arms and lift arm move in unison and substantially parallel to each other so said platform maintains a substantially horizontal orientation as it moves between lowered and elevated positions.

Eleven, the jack may include a detachable, elongated safety stop member that is manually detached and, when in an elevated position, is located so that at least a portion thereof engages a top edge of the base if the platform abruptly returns to the lowered position. In other words, the drive assembly fails, and the platform rapidly falls towards the ground, the safety stop member breaks this fall.

These features are not listed in any rank order nor is this list intended to be exhaustive.

DESCRIPTION OF DRAWING

Some embodiments of this invention, illustrating all its features, will now be discussed in detail. These embodiments depict the novel and non-obvious jack of this invention as shown in the accompanying drawing, which is for illustrative purposes only. This drawing includes the following figures (FIGS.), with like numerals indicating like parts.

DETAILED DESCRIPTION OF SOME EMBODIMENTS OF THIS INVENTION

Figure 1:
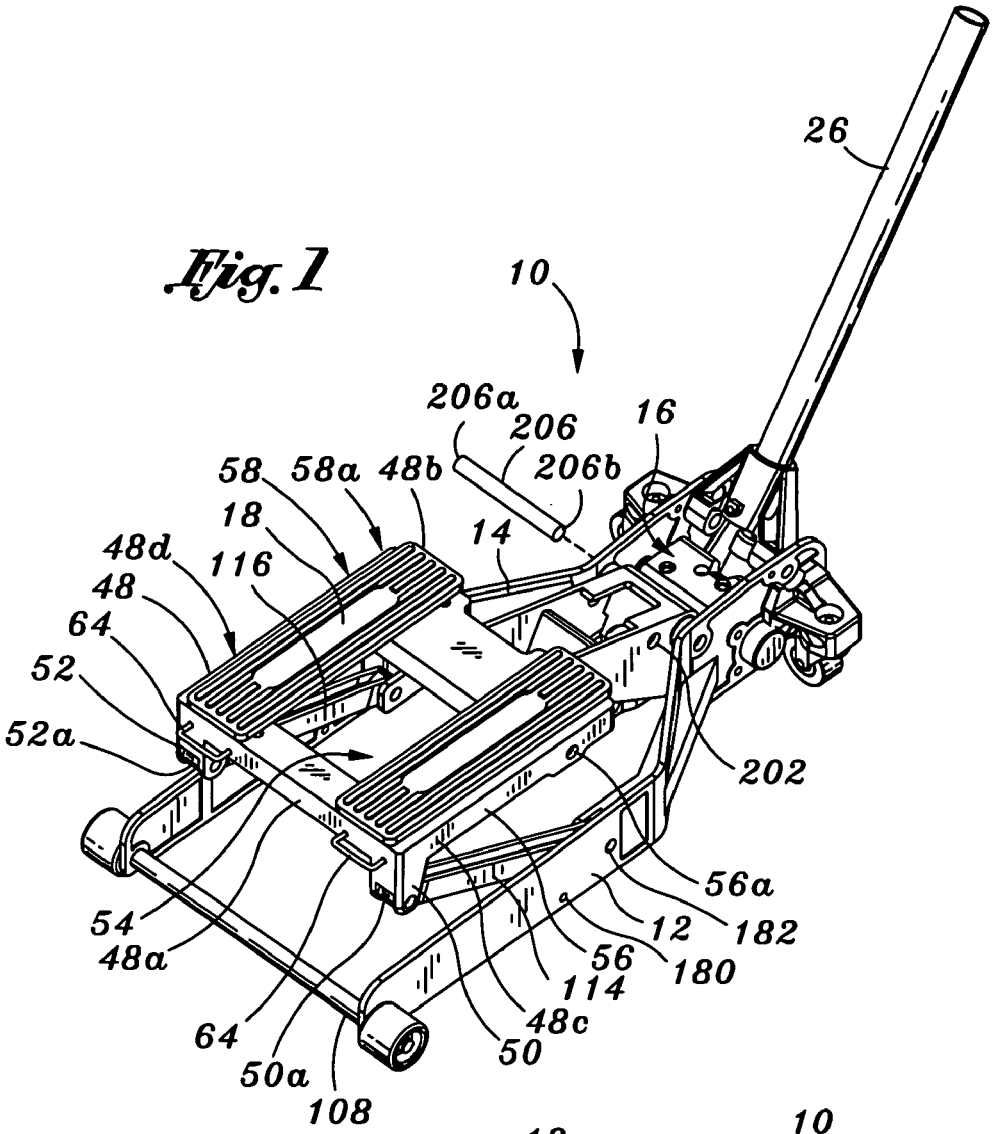
FIG. 1 is a left hand perspective view of a jack according to one embodiment of this invention.

As shown in FIGS. 1–4 and 6, one embodiment of this invention, a jack 10, includes a base 12, a horizontally oriented platform 18 when the jack is resting on ground that overlies a front portion of the base, a pair of support arms 114, 116 connecting to the platform and base, and a lift arm 14 connected between the platform and a drive assembly 16 mounted at or near a rear portion of the base. In accordance with one feature of this invention, the jack is light-weight, weighing less than about 85 pounds, and is designed to lift a light weight load such as a personal vehicle completely off the ground. Typically, the load does not exceed about 2500 pounds. Moreover, to reduce costs, standard components are used such as the drive assembly 16, commonly used in floor jacks that lift, for example, one end of an automobile but are not suited to lift a personal vehicle completely off the ground. To reduce weight, the base 12, platform 18, and lift arm 14 are cast from aluminum. Using such cast metal components not only reduces weight, but also eliminates many parts commonly found in conventional personal vehicle jacks.

Figure 3:
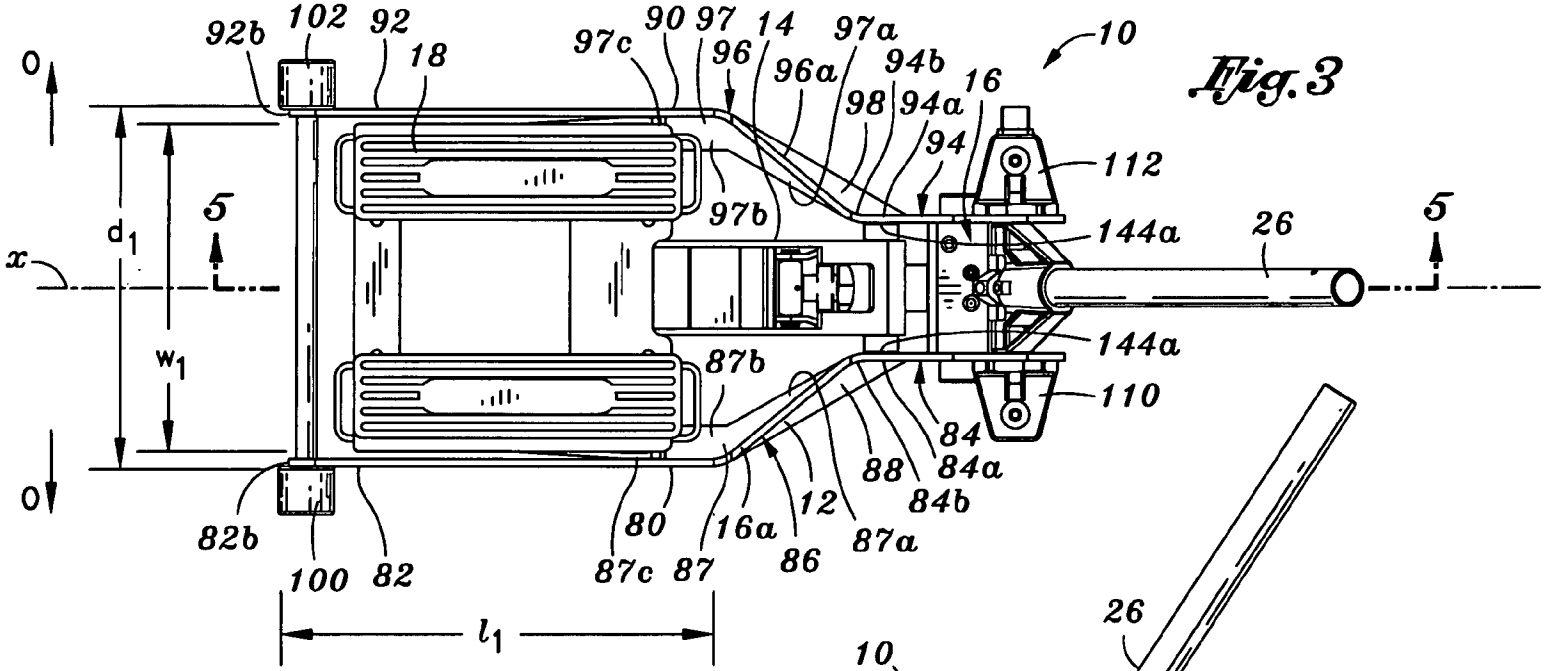
FIG. 3 is a top plan view of the jack in FIG. 1.
Figure 4:
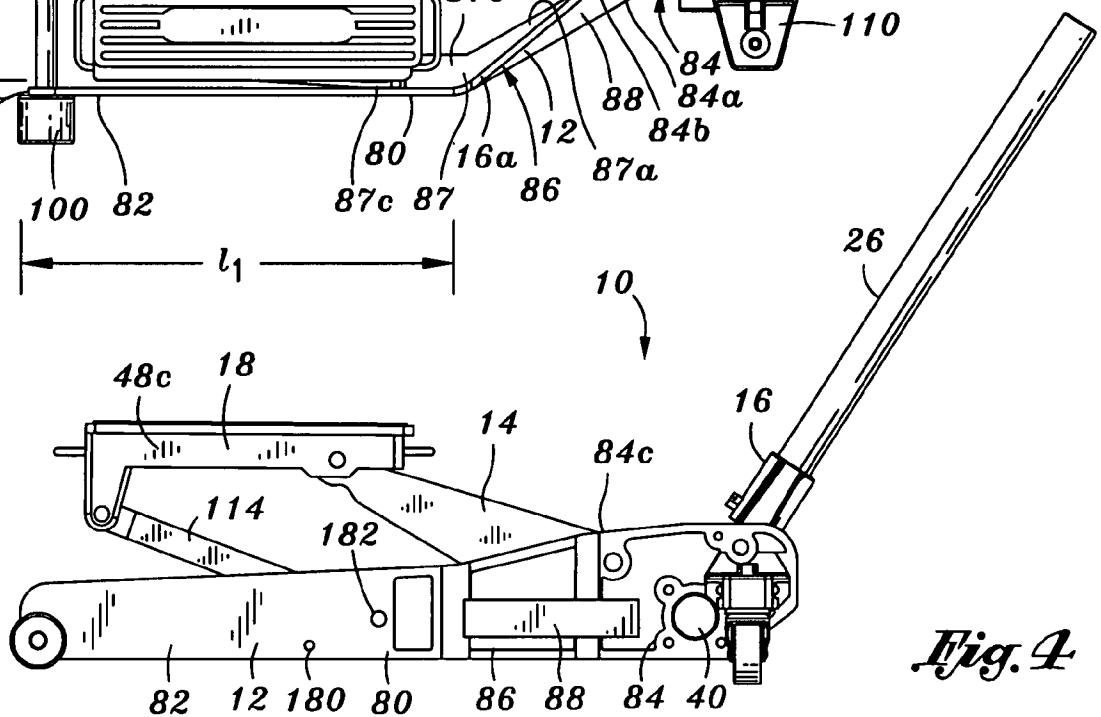
FIG. 4 is a side view of the jack in FIG. 1.
Figure 6:
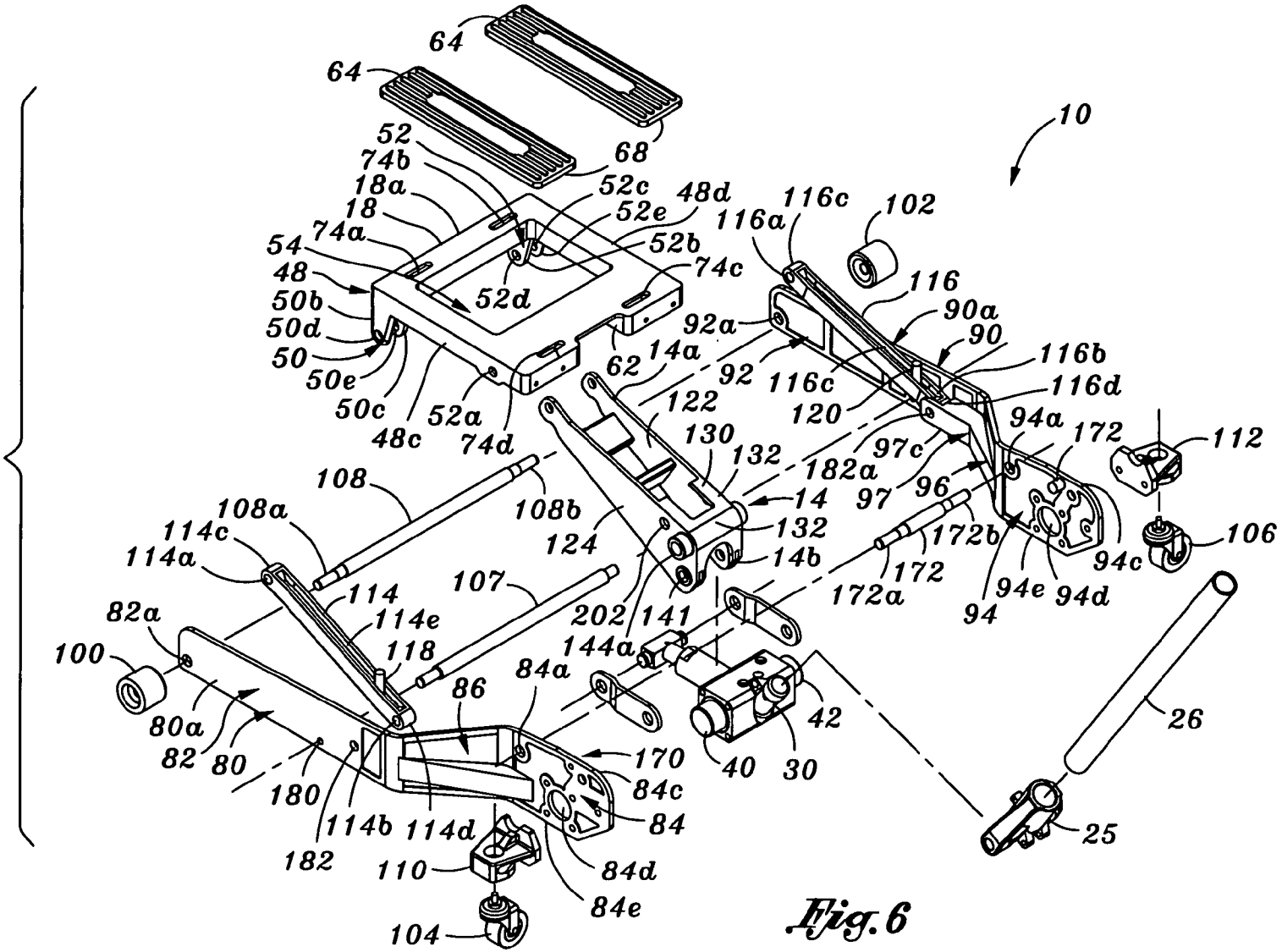
FIG. 6 is an exploded, perspective view of the jack shown in FIG. 2.
Figures 11, 12:
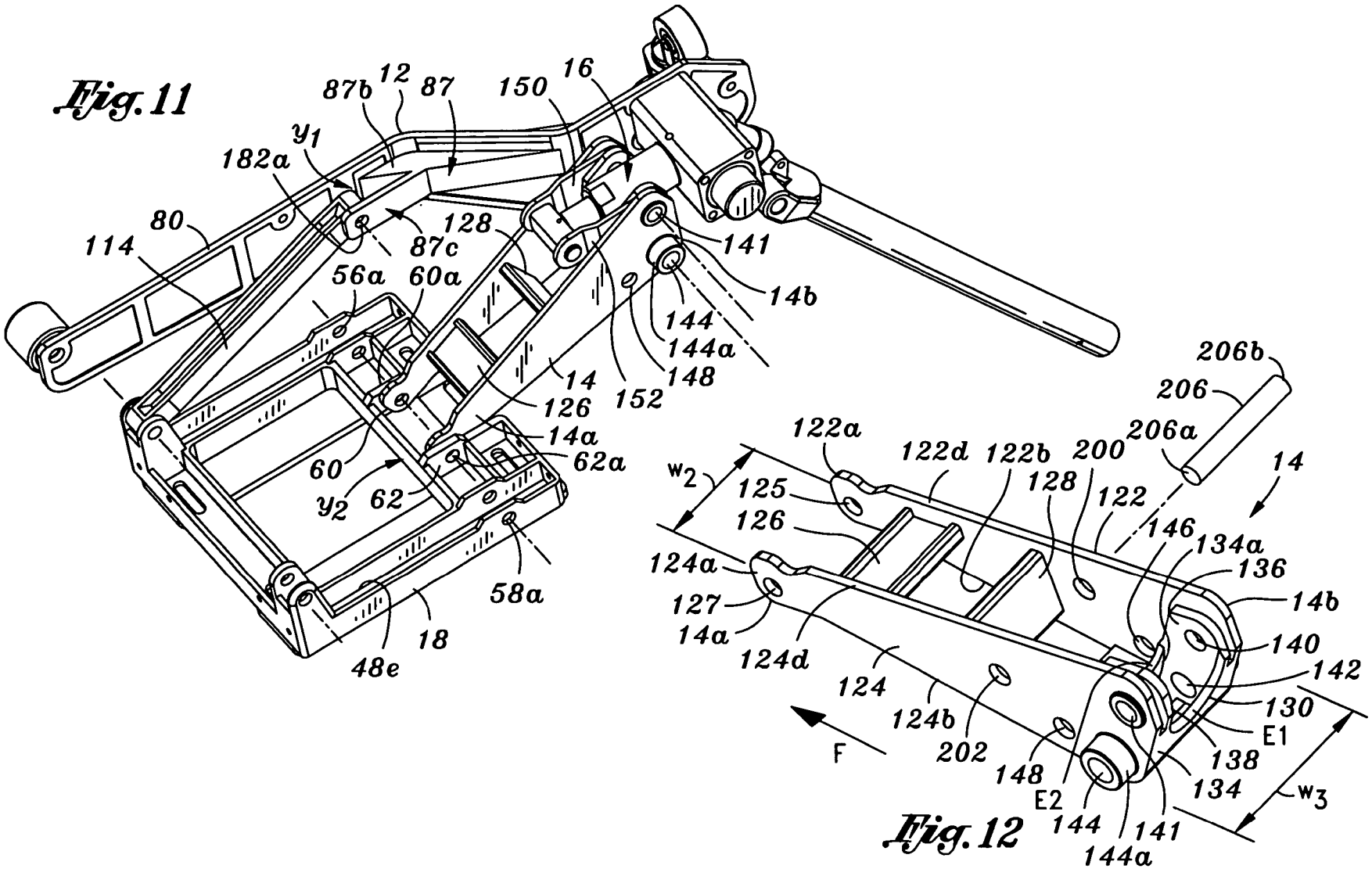
FIG. 11 is a perspective view showing the underside of the jack depicted in FIG. 1, with one side of the base removed.
FIG. 12 is a perspective view of the lift arm according to an embodiment of this invention.

As illustrated best in FIG. 6, the base 12 includes two separate components, a left side 80 and a right side 90, that are substantially mirror images of each other. Each side 80, 90 has a forward substantially planar segment 82, 92, a substantially planar rear segment 84, 94 that lies inward of the forward segment, and a substantially planar intermediate segment 86, 96 that connects the forward and rear segments. There are substantially triangular shaped outer braces 88, 98 (FIG. 3) integral with exteriors of the sides 80, 90, respectively, the brace 88 extending along the exterior of the intermediate segment 86 and its adjacent rear segment 84 and the brace 98 extending along the exteriors of the intermediate segment 96 and its adjacent rear segment 94. As best illustrated in FIG. 3 and 11, there is a substantially wedge shaped inner brace 87, 97 integral with the interiors of each side 80, 90, respectively. The inner braces 87, 97 each comprise a block having a triangular portion 87*a*, 97*a*, a rectangular portion 87*b*, 97*b* integral with triangular portion, and a flange 87*c*, 97*c*. As best depicted in FIG. 11, each flange 87*c*, 97*c* along with an adjacent portion of a side 80, 90, as the case may be, form a yoke Y1. There are holes 182*a* in each of these flanges 87*c*, 97*c* that are aligned with each other and with adjacent holes 182 in the sides 80, 90. The rectangular portions 87*b*, 97*b* are integral with the forward segments 82, 92 (FIG. 3) and the triangular portions 87*a*, 97*a* (FIG. 3) are integral with the intermediate segments 86, 96, respectively. The flanges 87*c*, 97*c* may be located at about the midpoint of the left 80 and right 90 sides, respectively.

As illustrated best in FIGS. 3 and 6, the forward segments 82, 92 are parallel, of equal lengths, in registration, and equidistance from the longitudinal axis X (FIG. 3) of the jack 10. Each forward segment 82, 92 forms a substantially vertical wall when the jack 10 is resting on ground, with a hole 82*a*, 92*a* (FIG. 6) nearby the fronts 82*b*, 92*b* (FIG. 6), respectively, a hole 180 (only one shown) nearby the intermediate segment 86, 96, respectively. As shown in FIG. 3, the forward segments 82 and 92 lie outward O of the platform 18 where the distance between the forward segments is slightly greater than the width $w_1$ (FIG. 3) of the platform. The distance $d_1$ between the forward segments 82, 92 is from about 10 to about 25 inches and the length $l_1$ of each forward segments 82, 92 is from about 10 to about 25 inches. These dimensions define a rectangular area over which the platform 18 lies and the platform may be substantially rectangular and have dimensions about equal to or slightly less (no more than about 5 percent) than this area.

As illustrated best in FIGS. 3 and 6, the rear segments 84 and 94, which are parallel and of equal lengths and in registration. Each form a substantially vertical wall when the jack 10 is resting on ground, with a hole 84*a*, 94*a* nearby the fronts 84*b*, 94*b* (FIG. 6) and tops 84*c*, 94*c* (FIG. 6) of each segment and another hole 84*d*, 94*d* nearby the middle bottom 84*e*, 94*e* of each segment. The rear segments 84 and 94 each lie laterally between the forward segments 82, 92 and straddle the longitudinal axis X of the jack 10. Each rear segment may be equidistance from this axis, typically from about 5 to about 10 inches from the longitudinal axis X. The intermediate segments 86 and 96 may slant inward towards each other to connect the forward segments 82, 92 and rear segments 84, 94, respectively. These intermediate segments 86 and 96 form substantially vertical walls and they have equal lengths from about 8 to about 12 inches. The forward segments 82 and 92, intermediate segments 86 and 96, and rear segments 84 and 94 may slope upward from the forward to rear segments to increase gradually in height. The height of these segments typically ranges from about 3 to about 7 inches.

As shown best in FIGS. 1 and 6, the platform 18, which may be cast from aluminum, comprises (a) a substantially rectangular, horizontally oriented, rectangular frame 48 having a pair of yokes 50, 52 each near a front corner of the platform and extending from an underside 48*e* (FIG. 11) of the forward end 48*a* of the platform, (b) a central, rectangular shaped opening 54, (c) pair of opposed sides 48*c*, 48*d*, and (d) a yoke Y2 (FIG. 11) including a pair of opposed, parallel walls 60, 62 extending along the underside 48*e* of the platform inward from the rear end 48*b* of the platform. An open end 50*a*, 52*a* (FIG. 1) of each yoke 50, 52 faces downward, and a pair of arms 50*b*, 50*c* and 52*b*, 52*c* (FIG. 6) of each yoke has a hole 50*d*, 50*e* and 52*d*, 52*e*, respectively. Each of the sides 48*c* and 48*d* has a horizontally orientated hole 56*a*, 58*a* near the rear end 48*b* of the platform 18. Each wall 60 and 62 extends from the rear end 48*b* of the platform 18 to the rectangular opening 54 of the platform, and each has a hole 60*a*, 62*a* that is aligned with the holes 56*a*, 58*a* of the outer, opposed sides 48*c* and 48*d*. These walls 60 and 62 (FIGS. 2 and 11) are equidistance from the longitudinal axis X and they are separated by a distance that is substantially equal the width $w_2$ (FIG. 12) of the forward end of the lift arm 14. This width $w_2$ ranges from about 3 to about 6 inches. U-shaped tie elements 64 may be attached to the forward end 48*a* and rear end 48*b* of the platform 18. Elastic bands (not shown) are wrapped or tie to these tie elements 64 (FIG. 1) and the vehicle being balanced on the platform 18 to hold the vehicle securely to the platform.

Figure 9:
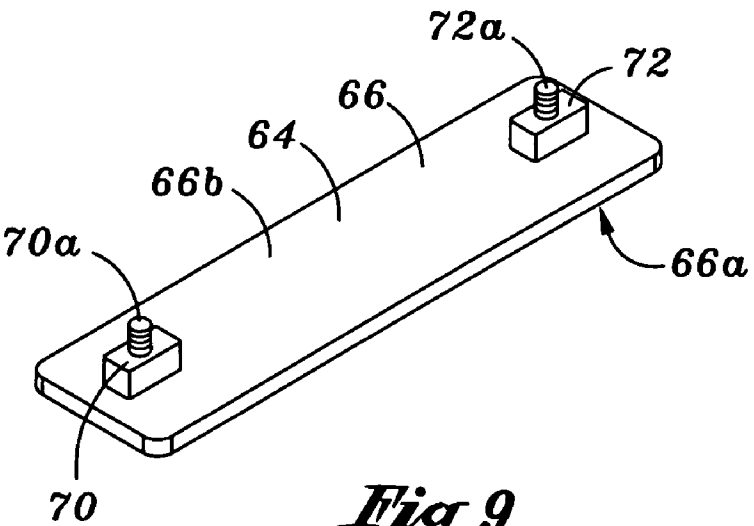
FIG. 9 is a perspective view of a grip pad according to an embodiment of this invention showing the underside of the grip pad.

A pair of laterally adjustable grips pads 64 (FIGS. 1 and 6) may be connected to the top side 18*a* of the platform 18. As illustrated in FIG. 9, each grip pad 64 comprises a metal plate 66 with a coating 68 preferably made from a non-slippery substance such as rubber applied to the top side 66*a* of the metal plate, and a pair of spaced-apart metal blocks 70, 72 located on the bottom side 66*b* of each of the metal plates. A threaded cylinder 70*a*, 72*a* extends outward from each of the metal blocks 70, 72, respectively. The grip pads 64 may be coupled to the platform 18 by inserting the threaded cylinders 70*a*, 72*a* through slots 74*a*, 74*b*, 74*c*, 74*d* of the platform, respectively, and attaching a nut (not shown) to each of the threaded cylinders. The location of each of the grip pads 64 on the platform 18 may be varied by sliding the threaded cylinders 70*a*, 72*a* along the slots 74*a*, 74*b*, 74*c*, 74*d* until a desired position is achieved. This provides more or less exposure of the rectangular opening 54 as may be need to accommodate the undercarriage of a vehicle being supported by the platform 18 or to better balance the vehicle on the platform.

Wheels 100, 102, 104 and 106 may be attached to the base 12. A stiffening rod 108, also functioning as an axle, may be attached to the left side 80 and right side 90 of the base 12 by passing a left end 108*a* and right end 108*b* of the rod through holes 82*a*, 92*a*, respectively. A secondary stiffening rod 107 may also extended between the left side 80 and right side 90 nearby the junctions between the forward segments 82 and 92 and the intermediate segments 86 and 96 of these sides. The front wheels 100, 102 may be attached to the rod 108 outboard of the left side 80 and right side 90. Referring to FIG. 3, the front wheels 100, 102 also each lie outward O of the platform 18. The rear wheels 104, 106 are caster type wheels and may be detachably connected to the rear segments 84, 94 of the base 12 by wheel mounts 110, 112 (FIG. 6). These wheel mounts 110, 112 are screwed or otherwise attached to the outer sides 80*a*, 90*a* of the rear segments 84, 94 of the base, respectively. In another embodiment, the wheel mounts may be integral (not detachable) with the rear segments 84, 94 of the base 12. Referring to FIG. 3, each of the wheel mounts 110, 112 lie inside of the forward segments 82, 92 of the base 12 but are outboard of the rear segments 84, 94.

Figure 2:
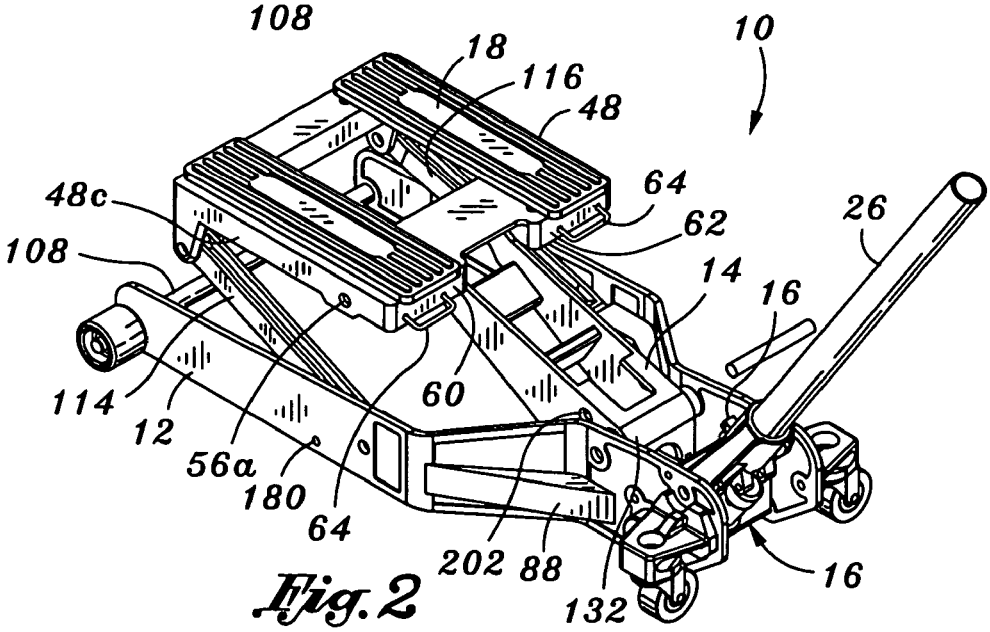
FIG. 2 is a right hand perspective view of the jack shown in FIG. 1.
Figure 10:
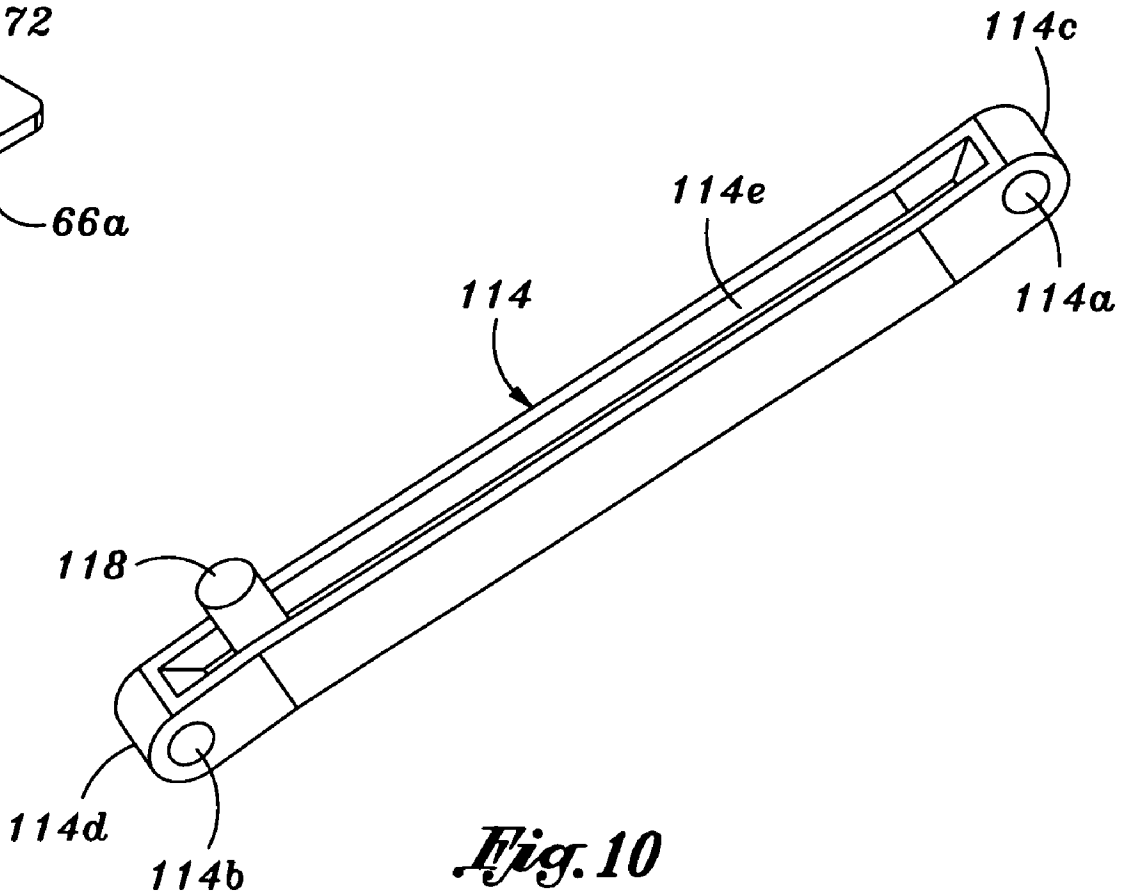
FIG. 10 is a perspective view of a support arm according to an embodiment of this invention showing the underside of the support arm.

As shown best in FIGS. 2, 6 and 10, a pair of support arms 114 and 116 each have opposed ends pivotably connected to the base 12 and platform 18. The support arms 114, and 116 each comprise an elongated bar having horizontally, orientated holes 114*a*, 114*b* (FIG. 10) and 116*a*, 116*b* at opposed ends 114*c*, 114*d* and 116*c*, 116*d*, respectively. A cylindrical stop member 118, 120 may be located in a channel 114*e*, 116*e* of each support arm 114, 116, nearby ends 114*d* and 116*d*, respectively. Pivot pins P1 (FIG. 5) extend through holes 114*a*, 116*a* in the support arms 114, 116 and the holes 50*d*, 50*e* and 52*d*, 52*e* in the yokes 50, 52 along the forward end 48*b* of the platform 18. In a similar manner, pivot pins P2 (FIG. 5) extend through holes 114*b* and 116*b* and the holes 180 in the sides 80,90 and the holes 182*a* in the flanges 87*c*, 97*c*. Each support arm 114, 116 is thus pivotably connected at opposed ends to the platform 18 and intermediary portions of the forward segments 82,92 of the base 12.

Referring to FIGS. 6, 11 and 12, the lift arm 14 is a rigid, unitary member that may be cast from aluminum. It is connected to pivot at its opposed forward end 14*a* and rear end 14*b* respectively to the platform 18 and the drive assembly 16. The lift arm 14 includes a left triangular wall 124 and a right triangular wall 122 that are substantially parallel. It also includes a front connector 126 at the forward end 14*a*, a middle connector 128, and rear connecter 130 at the rear end 14*b*; all extending between the walls 122 and 124 substantially at a right angle. These triangular walls 122, 124 each have a horizontally orientated hole 125, 127 near the front ends 122*a*, 124*a* aligned with each other, a horizontally orientated hole 146, 148, near the rear of these walls aligned with each other, and a horizontally orientated hole 200, 202 between the middle connector 128 and the rear end 14*b* of the lift arm.

The rear connector 130 provides a housing for the drive assembly 16. As best shown in FIGS. 11 and 12, the rear connector 130 includes a top plate 132 (FIGS. 1 and 2), a rear wall 134 and a parallel front wall 134*a*, each having concave edges E1 and E2 respectively, and a left sidewall 136 and a right sidewall 138. The top plate 132 is U-shaped and is flush with the top edges of the triangular walls 122 and 124. The top plate 132 is open-ended facing forward F. The rear wall 134 is U-shaped, having an open end facing towards the bottom sides 122*d*, 124*d* of the triangular walls 122 and 124. The sidewalls 136 and 138 are spaced from adjacent portions of the rear segments 84 and 94 to provide a space for links 150 and 152 of the drive assembly 16. There is in each sidewall 136,138 a horizontally, orientated hole 140 (only one shown in FIG. 12) passing therethrough. The holes 140 in each of these sidewalls 136 and 138 are aligned. There are holes 141 (only one shown in FIG. 12) in the triangular walls 122 and 124 that are aligned with the holes 140. A cylindrical boss 144*a* (only one shown in FIG. 12) projects outward from each of the triangular walls 122 and 124 near the rear end 14*b* and there are holes 144 in each of these bosses that are aligned. As illustrated in FIG. 3, the bosses 144*a* act as spacers to maintain the rear segments 84,94 and the triangular walls 122, 124 a fixed distance way from each other.

As shown in FIG. 3, to connect the forward end 14*a* of the lift arm 14 to a central portion of the rear of the platform 18, the holes 125 and 127 at the forward end of the lift arm 14 are aligned with the holes 60*a*, 62*a* in the walls 60, 62 of the yoke Y2 (FIG. 11) and a pivot pin P3 is then inserted into these aligned holes. In an alternate embodiment, the forward end 14*a* of the lift arm 14 may be pivotably connected to the platform 18 using a rod that passes through holes 125 and 127 of the lift arm, holes 60*a* and 62*a*, as well as holes 56*a* and 58*a*, of the platform. The rear end 14*b* of the lift arm 14 is pivotably connected to the base 12 by a dowel 172 that extends through the aligned holes 144 in the bosses 144*a*. The opposed ends 172*a* and 172*b* respectively of the dowel 172 are received in the aligned holes 84*a* and 94*a* in the rear segments 84 and 94. When the drive assembly 16 actuates the lift arm 14, the lift arm pivots about the dowel 172.

Figures 5, 5A:
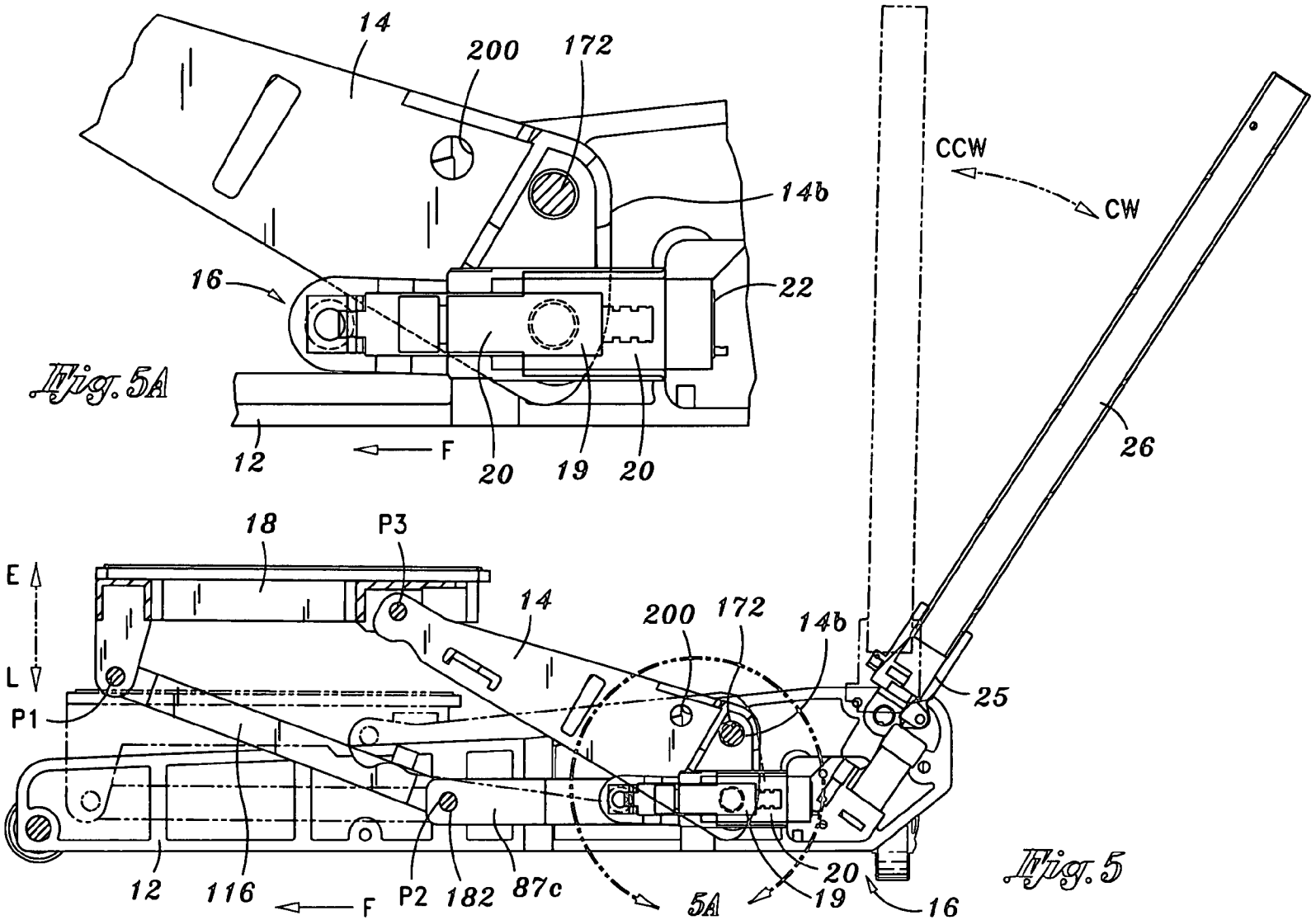
FIG. 5 is a cross-sectional view taken along line 5—5 in FIG. 3 illustrating movement of the support arms, platform, lift arm, and handle.
FIG. 5A is an enlarged, fragmentary view taken along line 5A in FIG. 5.
Figure 8:
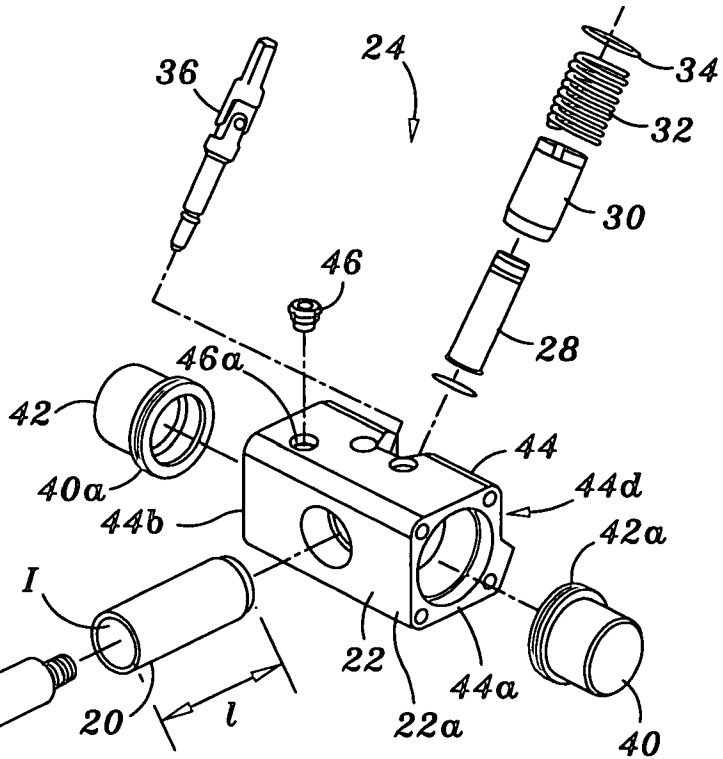
FIG. 8 is an exploded, perspective view of the drive assembly shown in FIG. 7.
Figure 7:
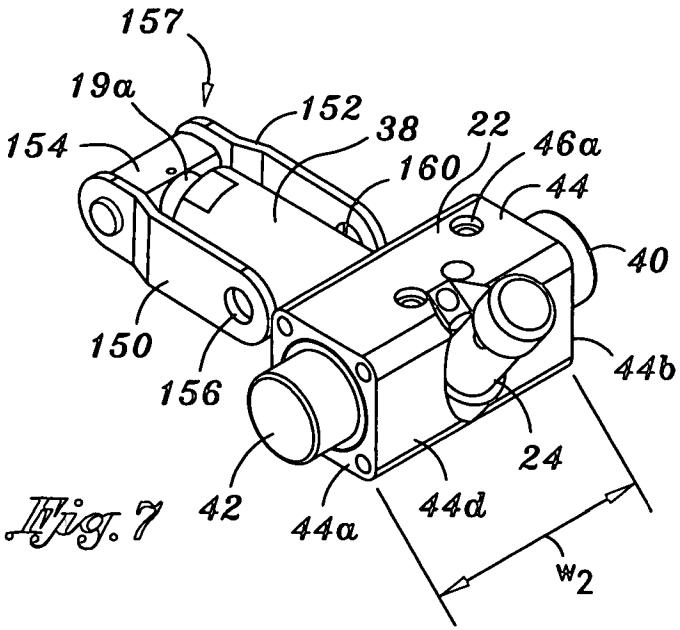
FIG. 7 is a perspective view of a drive assembly according to one embodiment of this invention.

As depicted in FIGS. 5A, 7 and 8, the drive assembly 16 is of a conventional design and includes a ram 19 disposed within a cylinder 20, a fluid chamber 22, and a manually operated pump 24. The longitudinal axis of the cylinder 20 is substantially horizontally orientated. The pump 24 is partially disposed within the fluid chamber 22, and includes a detachable handle 26, a pump core 28, pump case 30, a spring 32, a piston cover 34 and a discharge valve rod 36 for a valve (not shown). The handle 26 is attached to the pump case 30 by a handle base 25. The cylinder 20 is encased in a sleeve 38 and it extends from the front side 22*a* of the fluid chamber 22. This cylinder 20 has, for example, a circular cross-section. The fluid chamber 22 has an internal cavity (not shown) holding hydraulic fluid and a pair of cylindrical caps 40, 42, closing the cavity, each cap having a threaded portion 40*a*, 42*a*, respectively, that is used to attach the caps to a main body 44 of the fluid chamber.

The main body 44 may be box-like in shape, having a left wall 44*a* and a right wall 44*b* separated by a distance that is about equal to the distance between the two rear segments 84 and 94 of the base 12. By inserting the caps 40 and 42 into the holes 84*d* and 94*d*, respectively, the drive assembly 16 is connected between the rear segments 84 and 94 abutting, respectively, the left wall 44*a* and right wall 44*b* (FIG. 8) of the drive assembly 16. A removable fluid plug 46 seals an access port 46*a* that enables fluid to be put into the fluid chamber 22. The ram 19 is mounted to slide forward and rearward within the cylinder 20 and the cross-section of the ram may be identical in shape as the interior I of the cylinder. While one embodiment of a drive assembly 16 is described, other types of drive assemblies may be used such as described in U.S. Pat. Nos. 2,629,583, 3,807,694, and 4,018,421. The sleeve 38 abuts the upper edges E1 and E2 of the rear and front walls 134 and 134*a*, respectively The lift arm 14 is connected to the drive assembly 16 by means of a U-shaped member 157 including a block 154 having a pair of fingers 154*a*, 154*b*, each pivotably connected to one of a pair of links 150 and 152 that extend towards the main body 44 of the fluid chamber 22. The block 154 is connected to a front end 19*a* (FIG. 7) of the ram 19. Each link 150, 152 comprises an elongated, rigid bar each having opposed holes 153 and 156, and 158 and 160, respectively. The fingers 154*a* and 154*b*, fit into the holes 153 and 158, respectively, with the fingers serving as pivot pins. The other ends of the links 150 and 152 are pivotably attached to the rear connecter 130. A pivot pin P4 is aligned with the aligned holes 140 and 141 respectively in the left sidewall 136 of the rear connector 130 and right triangular wall 122 and these aligned holes are aligned with the hole 156 in the link 150. This pivot pin P4 extends through these aligned holes 140, 141, and 156. A pivot pin P5 is aligned with the aligned holes 140 and 141 respectively in the right sidewall 138 of the rear connector 130 and left triangular wall 124 and these aligned holes are aligned with the hole 160 in the link 152. This pivot pin P5 extends through these aligned holes 140, 141, and 160.

Referring to FIG. 5, with the platform 18 in its lowered position shown in dotted lines, the drive assembly 16 is manually actuated to move the platform to one of a plurality of different elevated positions shown in solid lines. The ram 19 is now in a fully retracted condition. To achieve this the user moves the handle 26 first in a downward stroke in a clockwise (CW) direction whereby fluid is moved by the pump 24 from the fluid chamber 22 into the cylinder 20. Moving the handle 26 in an upward stroke in a counter-clockwise (CW) direction does nothing. When fluid enters the cylinder 20, the ram 19 moves outward along the longitudinal axis of the cylinder, pushing the block 154 outward towards the main body 44 of the fluid chamber 22, causing the links 150 and 152 to pull on the lift arm 14. This causes the lift arm 14 to pivot about the dowel 172, rotating in a clockwise direction as viewed in FIG. 5 to move the platform 18 from the lowered position to the elevated position. As the lift arm 14 rotates, the support arms 114 and 116 rotate in unison therewith and parallel thereto maintaining the platform 18 substantially horizontal as it is elevated.

Repeatedly reciprocating the handle 26 in the clockwise and counter-clockwise direction will continue to elevate the platform 18. Stop members (not shown) are located on the base 12 to limit rotation of the handle 26. To lower the platform 18 to return it to its lowered position shown in dotted lines in FIG. 5, the handle 26 is twisted to actuate the discharge valve rod 36, allowing fluid to move slowly from the cylinder 20 into the fluid chamber 22, with the platform lowering as the fluid returns to the fluid chamber. The handle 26 has a sufficient length to allow a user that is standing upright to actuate the handle without having to significantly adjust his or her posture.

When the platform 18 is elevated, it is desirable to prevent its returning to the lowered position in the event a failure occurs in the drive assembly 16, for example, hydraulic fluid rapidly escaping from the cylinder 20. One way is to provide a safety stop member such as, for example, a detachable, elongated shaft 206 that is mounted to the base 12 for example. With the platform 18 elevated, the shaft 206 is detached and inserted in the aligned holes 200 and 202. If the platform 18 suddenly moves downward because of the failure in the drive assembly 16, the outer ends 206*a* and 206*b* of the shaft 206 are located to engage a top edge of the base 12 to prevent the elevated platform from abruptly returning to the lowered position shown in solid lines in FIG. 5.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A jack comprising a base comprising a pair of spaced apart, rigid side members having substantially the same length and being substantially mirror images of each other, each side member having a forward segment, a rear segment, and an inward tapering intermediate segment at substantially the same location along each side member between the forward and rear segments, said forward segments of each side member having substantially equal lengths, said rear segments of each side member having substantially equal lengths, and said intermediate segments of each side member having substantially equal lengths, the lengths of the rear segments being less than the lengths of the forward segments, said forward segments each terminating in a front end and said front ends being opposite each other, said forward segments being substantially parallel to each other and separated by a first predetermined distance and said rear segments being opposite each other and substantial parallel to each other and separated by a second predetermined distance that is less than the first predetermined distance, a stiffening element extending between the front ends of each of said forward segments, said stiffening element serving as an axle having opposed ends with a wheel mounted on each end of the stiffening element outboard of the side members, a substantially horizontally oriented platform having a forward end, a rear end, opposed sides, and an upper surface adapted to support a load in an elevate position with the entire load above ground level, said platform having a width that is substantially equal to said first predetermined distance and a length that is substantially equal to said predetermined length of the forward segments, a first single support arm connected between one side member and the platform and a second single support arm connected between the other side member and the platform, each support arm having one end pivotably connected to the forward end of the platform and another end pivotably connected to the forward segment of the side member to which said support arm is connected, a lift arm having a forward end pivotably connected to the rear end of the platform at a central portion thereof and a rear end pivotably mounted between the rear segments of the side members, a driver assembly mounted between the rear segments of the side members, said driver assembly in response to manual actuation moving said support arms and lift arm substantially in parallel so said platform maintains a substantially horizontal orientation as it moves between lowered and elevated positions.

2. The jack of claim 1 where the side members, platform and lift arm are of cast metal.

3. The jack of claim 2 where the cast metal is aluminum and weighs less than substantially 85 pounds.

4. The jack of claim 1 where the forward and rear segments of the side members are substantially planar and substantially vertically oriented when the jack is resting on the ground.

5. The jack of claim 1 having a longitudinal axis and said forward segments are in registration with each other and equidistance from the longitudinal axis and said rear segments are in registration with each other and equidistance from the longitudinal axis.

6. The jack of claim 1 where the forward segments each comprise at least substantially 50 percent of the length of the side member and the rear segments each comprise no more than substantially 25 percent of the length of the base.

7. The jack of claim 6 where the platform has a substantially rectangular configuration of predetermined dimensions and the forward segments at least in part define a rectangular area of the base having dimensions substantially the same as the predetermined dimensions of the platform, said platform overlying said area when in the lowered position.

8. A jack weighing less than substantially 85 pounds and comprising a cast aluminum base having a longitudinal axis and first and second spaced apart, unitary side members straddling said longitudinal axis that are mirror images of each other, each side member having a forward segment, a rear segment and an intermediate segment between the forward and rear segments, said intermediate segments pointing inward towards the longitudinal axis and said forward segments each terminating in a front end and said front ends being opposite each other, said forward segments being in registration and parallel to and equidistance from the longitudinal axis and said rear segments being in registration and parallel to and equidistance from the longitudinal axis, a stiffening element extending between the front ends of each of said forward segments, said stiffening element serving as an axle having opposed ends with a wheel mounted on each end of the stiffening element, a substantially horizontally oriented, cast aluminum platform having a forward end, a rear end and an upper surface adapted to support a load in an elevated position with the entire load above ground level, said platform having a substantially rectangular configuration of predetermined dimensions and the forward segments at least in part defining a rectangular area of the base having dimensions substantially the same as the predetermined dimensions of the platform, a first support arm connected between one side member and the platform, and a second support arm connected between the o side member and the platform each support arm having one end pivotably connected to the forward end of the platform and another end pivotably connected to the forward segment of the side member to which said support arm is connected, a cast aluminum lift arm having a forward end pivotably connected to the rear end of the platform at a central portion thereof and a rear end having a first section pivotably connected to one side member at the rear segment thereof and a second section pivotably connected to the other side member at the rear segment thereof, a driver assembly mounted to the rear segment of the base between the side members, said driver assembly including a hydraulic cylinder having ram element coupled to the lift member, said ram element in response to manual actuation moving substantially horizontal causing the platform to move between a lowered position and elevated position, said platform overlying and in substantial registration with said rectangular area of the base when in the lowered position.

9. The jack of claim 8 where the forward segments each comprise at least substantially 50 percent of the length of the side member and the rear segments each comprise no more than substantially 25 percent of the length of the base.

10. A jack including a base having a pair of spaced apart substantially planar side members, each side member having a forward segment, a rear segment and an inward projecting intermediate segment connecting the forward and the rear segments to provide a front base portion having a width dimension that is greater than a width dimension of the rear portion, said forward, rear and intermediate segments being in registration, said forward segments each terminating in a front end and said front ends being opposite each other, a stiffening element extending between the front ends of each of said forward segments, said stiffening element serving as an axle having opposed ends with a wheel mounted on each end of the stiffening element, a substantially horizontally oriented, substantially rectangular platform of predetermined dimensions, said stiffening element and parallel forward segments defining at least in part boundaries of a rectangular area of the base having dimensions substantially the same as the predetermined dimensions of the platform, so that when said platform is in a lowered position said platform overlies said front base portion and substantially covers the rectangular area, support arms each having one end pivotably connect the platform and another end pivotably connected to one of the side members, a lift arm having one end pivotably connected to the platform and another end connected to the rear portion, said lift arm being positioned lengthwise along a longitudinal axis of the jack, and a driver assembly mounted to a rear portion of the base that in response to manual actuation moves the platform between a lowered and a plurality elevated positions, said support arms and lift arm moving in parallel upon actuation of the drive assembly to maintain the platform horizontally oriented.

11. The jack of claim 10 where said substantially rectangular area has a length substantially from 10 to 25 inches and a length width substantially from 10 to 25 inches.

12. The jack of claim 11 where said base has an length substantially from 30 to 40 inches and the forward segments comprise at least substantially 50 percent of the length of the base and the rear segments comprise no more than substantially 25 percent of the length of the base.

* * * * *

UNITED STATES PATENT AND TRADEMARK OFFICE

CERTIFICATE OF CORRECTION

PATENT NO. : 7,137,615 B2
APPLICATION NO. : 10/814415
DATED : November 21, 2006
INVENTOR(S) : Hector Ray Hernandez, Jr.

It is certified that error appears in the above-identified patent and that said Letters Patent is hereby corrected as shown below:

Title Page, Item (12) delete "Ray, Jr. et al." and insert --Hector Ray Hernandez, Jr. et al.--; and Title Page, Item (73), delete "All Trade Tools LLC" and insert --Alltrade Tools LLC--

Signed and Sealed this

Thirteenth Day of February, 2007

JON W. DUDAS
*Director of the United States Patent and Trademark Office*